US009333616B2

(12) United States Patent
Mak

(10) Patent No.: US 9,333,616 B2
(45) Date of Patent: May 10, 2016

(54) SELF-LEVELING SANDPAPER GRINDING MACHINE

(71) Applicant: Kai Sin Mak, Kowloon (HK)

(72) Inventor: Kai Sin Mak, Kowloon (HK)

( * ) Notice: Subject to any disclaimer, the term of this patent is extended or adjusted under 35 U.S.C. 154(b) by 192 days.

(21) Appl. No.: 14/167,260

(22) Filed: Jan. 29, 2014

(65) Prior Publication Data

US 2015/0072600 A1 Mar. 12, 2015

(30) Foreign Application Priority Data

Sep. 9, 2013 (CN) ..... 2013 1 0407223

(51) Int. Cl.
*B24B 23/02* (2006.01)
*B24B 47/12* (2006.01)
*B24D 9/08* (2006.01)

(52) U.S. Cl.
CPC ..... *B24B 23/02* (2013.01); *B24B 47/12* (2013.01); *B24D 9/08* (2013.01)

(58) Field of Classification Search
CPC ... B23F 23/1262; B24B 23/02; B24B 23/022; B24B 27/0084; B24B 45/00; B24B 47/12; B24D 5/16; B24D 7/16; B24D 9/08
See application file for complete search history.

(56) References Cited

U.S. PATENT DOCUMENTS 2,854,829 A * 10/1958 Porter ..... B24B 45/00 403/135
4,709,513 A * 12/1987 Tingley ..... B24B 7/24 451/359
5,662,436 A * 9/1997 Bishop ..... B23C 5/2269 407/35
6,244,943 B1 * 6/2001 Bohler ..... B24B 11/00 451/294
6,780,087 B2 * 8/2004 Minegar ..... B24B 45/00 254/354
7,887,395 B2 * 2/2011 Weiford ..... B24B 7/184 451/354
8,029,341 B2 * 10/2011 Belly ..... B24B 13/01 451/259
2005/0090190 A1 * 4/2005 Rudolph ..... B23Q 11/0046 451/270
2008/0201877 A1 * 8/2008 Sengewald ..... A47L 11/085 15/4
2015/0231756 A1 * 8/2015 Roeck ..... B24B 23/02 451/177
2015/0239092 A1 * 8/2015 Pierednik ..... B24B 45/00 451/28

* cited by examiner

*Primary Examiner* — Timothy V Eley
(74) *Attorney, Agent, or Firm* — Birch, Stewart, Kolasch & Birch, LLP

(57) ABSTRACT

A self-leveling sandpaper grinding machine includes a base part including a seat, a motor frame fixed to the seat and a motor supported on the motor frame. A decelerator is connected to an output shaft of the motor wherein an output shaft of the decelerator penetrates the seat and extends to the other side. A grinder part is attached to the seat and is opposing to the motor. A tray includes four barrier strips provided on the tray and forming a quadrangle. U-shaped clip seats are provided along diagonals of the quadrangle with elastic pads inserted into sockets formed by the barrier strips and clip seats. Sandpaper is placed on the elastic pads with U-shaped clips for engaging with the clip seats and fastening the sandpaper together with the clips. A transmission mechanism is provided on the tray for coupling with the output shaft of the decelerator.

18 Claims, 4 Drawing Sheets

SELF-LEVELING SANDPAPER GRINDING MACHINE

CROSS-REFERENCE TO RELATED APPLICATIONS

The application claims the priority benefits of Chinese Patent Application No. 201310407223.5 filed on Sep. 9, 2013, the contents of which are hereby incorporated by reference in its entirety.

FIELD OF THE INVENTION

The present invention generally relates to a grinding tool, and particularly to a handheld self-leveling sandpaper grinding machine.

BACKGROUND OF THE INVENTION

Sandpaper grinding machines are used for smoothing, grinding and/or polishing surfaces of soft and/or rigid materials of planks and various metal sheets in field of decoration engineering. Handheld sandpaper grinding machines includes manual type and electrical type. Currently, grinding sheets, such as sandpaper, are generally used for manually grinding or polishing working surfaces, such as surfaces of planks. During the course of manually grinding, a user holds sandpaper in his hand and moves the same on working surfaces backwards and forwards. However, the grinded surfaces would still not be smooth enough. Thus, manual grinding is a very laborious task. To make it easy to grind manually, sandpaper is usually placed on and held by a sanding block (also called as sandpaper block), to make it convenient for the user to grasp. Grinding blocks are well-known in the prior art. In most paint engineering for decorating walls, workers carry out polishing procedures by holding sandpaper by hand or placing sandpaper on surface of sponges. In this matter, the working intensity of the polishing procedures is heavy, the working efficiency is low, but the polished surface is not smooth enough. Currently, there are several kinds of conventional handheld electrical grinding machines, which are suitable for grinding rigid materials, such as metal. But, they are not suitable for polishing procedures for plaster walls since their speed of revolution is very high, and it is very hard to hold such kinds of machines during its operation. In this connection, such kinds of grinding machines have not been applied in polishing plaster walls. There are also several kinds of small-sized electrical grinding machines which make it possible for holding the machines during operation. However, as the power of the machines is low, they are not suitable for industrial use.

SUMMARY OF THE INVENTION

The present invention aims to provide a self-leveling sandpaper grinding machine, which could level sandpaper of a grinder part automatically, to enable the sandpaper to be attached to the object to be grinded tightly, and make it easy to discharge chips. The structure of the present machine is simple and the operation thereof is convenient.

According to the present invention, the self-leveling sandpaper grinding machine may comprise: a base part including a seat, a motor frame fixed in the middle of the seat, a motor supported on the motor frame, a decelerator connected to an output shaft of the motor, in which an output shaft of the decelerator penetrates the seat and extends to the other side of the seat; and a grinder part attached to the seat and being opposite to the motor with respect to the seat, which includes a tray, four barrier strips provided on the tray and substantively forming a quadrangle, U-shaped clip seats provided along the diagonals of the quadrangle, elastic pads inserted into sockets formed by the barrier strips and U-shaped clip seats in which the height of each elastic pad is slightly higher than that of each barrier strip or U-shaped clip seat, sandpaper placed on the elastic pads, U-shaped clips for engaging with the U-shaped clip seats and fastening the sandpaper together with the U-shaped clip seats, and a transmission mechanism provided on the tray and for coupling with the output shaft of the decelerator.

Preferably, the decelerator may include a gear decelerator and a worm gear decelerator, in which the gear decelerator includes a small gear connected to the output shaft of the motor and a large gear engaging with the same gear, while the worm gear decelerator includes a worm connected to the large gear and a worm gear engaging with the worm, in which a center shaft of the worm gear constitutes the output shaft of the decelerator.

To enable the user to control the machine conveniently, the base part could be provided with a handle which is fixed to the motor on one side and is fixed to the seat by virtue of a handle tail on the other. The handle could be provided with a start bottom of the motor.

To enable to level the sandpaper automatically in accordance with the surface of the object to be grinded, the transmission mechanism may include an inner-hexagon bolt fixed to the tray and a main shaft including six inclined planes at an angle of 10°-15° and coupled with a hex socket of the inner-hexagon bolt.

A screw hole may be formed into a lower end of the output shaft of the decelerator, while a screw may be formed on surface of an end of the main shaft of the transmission mechanism to couple with the screw hole. Or, a hole may be formed into a lower end of the output shaft of the decelerator with a key slot formed into a wall of the hole, while a key may be formed on surface of an end of the main shaft of the transmission mechanism to couple with the key slot.

Each of the elastic pads may be a sponge pad, while the operation of the grinder part is in a range of 200-500 rpm.

BRIEF DESCRIPTION OF THE DRAWINGS

The present invention will be described in details with reference to the accompanying drawings. The above and/or other features and advantages of the present invention will be better understood by those skilled in the art. The components or elements in the accompanying drawings are for illustration purpose only, and not drawn in scale, in which.

DETAILED DESCRIPTION OF THE INVENTION

The self-leveling sandpaper grinding machine of the present invention will be described in details with reference to the embodiment shown in the accompanying drawings. However, it should be understood that the embodiment should not be construed as limitation to the protective scope of the present invention.

Figure 1:
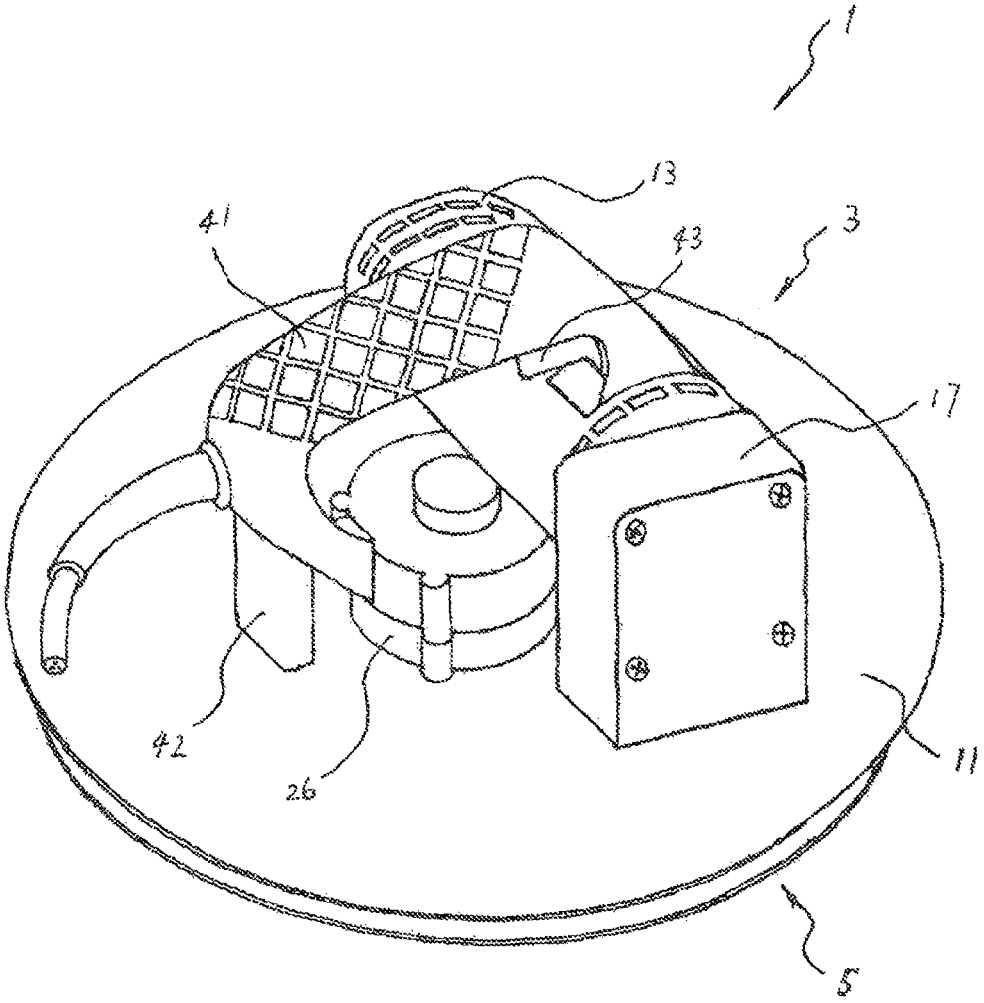
FIG. 1 is a schematic perspective view of an embodiment of the self-leveling sandpaper grinding machine of the present invention.

FIG. 1 illustrates the structural assembly of the self-leveling sandpaper grinding machine of the present invention. The self-leveling sandpaper grinding machine 1 comprises a base part 3 and a grinder part 5.

Figure 2:
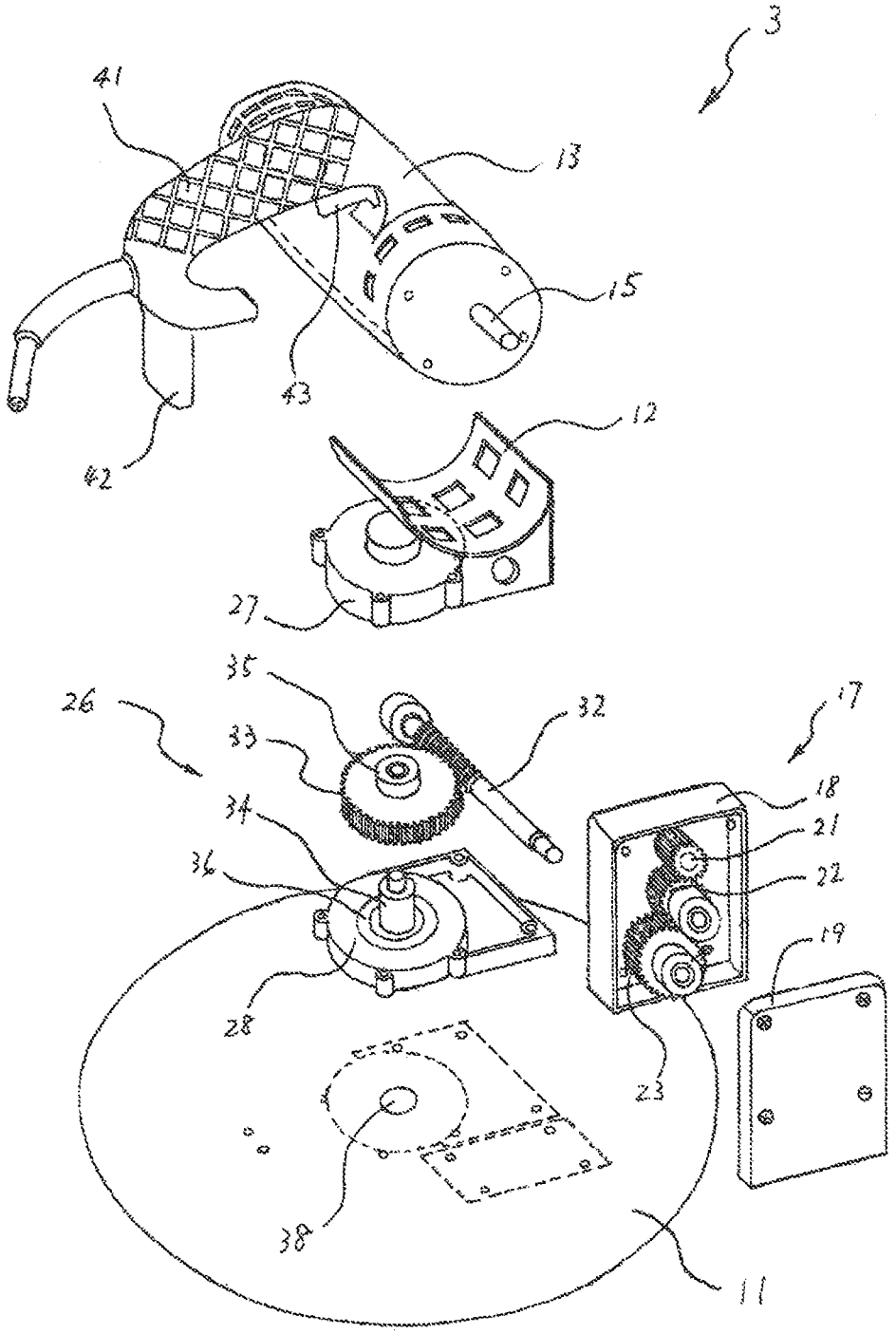
FIG. 2 is a schematic exploded view of a base part of the self-leveling sandpaper grinding machine shown in FIG. 1.

FIG. 2 is the base part 3 of the self-leveling sandpaper grinding machine 1 of the present invention. As shown in FIG. 2, the base part 3 includes a seat 11, a motor frame 12 fixed in the middle of the seat 11, a motor 13 supported on the motor frame 12, a gear decelerator 17 connected to an output shaft 15 of the motor 13 and a worm gear decelerator 26 connected to the gear decelerator 17. The gear decelerator 17 includes a box 18, a box cover 19, a small gear 21 connected to the output shaft 15 of the motor and a large gear 23 engaging with the small gear 21 through an idle gear 22. The worm gear decelerator 26 includes an upper bearing housing 27, a lower bearing housing 28, a worm 32 connected to the large gear 23, and a worm gear 33 engaging with the worm 32. A center shaft 34 of the worm gear 33 is supported on the upper and lower bearing housings 27 and 28 by virtue of an upper and a lower bearings 35 and 36. The center shaft 34 passes through a central hole 38 of the seat 11 and extends downwards. An end of the center shaft 34 is provided with a coupling device, such as a screw hole formed into the lower end of the shaft, or a hole formed into the lower end of the shaft with a key slot into its wall (not shown in the figures), for transferring power to the grinder part 5. The base part 3 is also provided with a handle 41 which is fixed to the motor 13 on one side, and is fixed to the seat 11 by virtue of a handle tail 42 on the other. The handle 41 is provided in such a manner that the handled 41 could be held stably when the sandpaper grinding machine 1 is operated in a vertical position or upwards position. A start button 43 of the motor could be set on the handle 41, to enable the user to control the motor conveniently.

Figure 3:
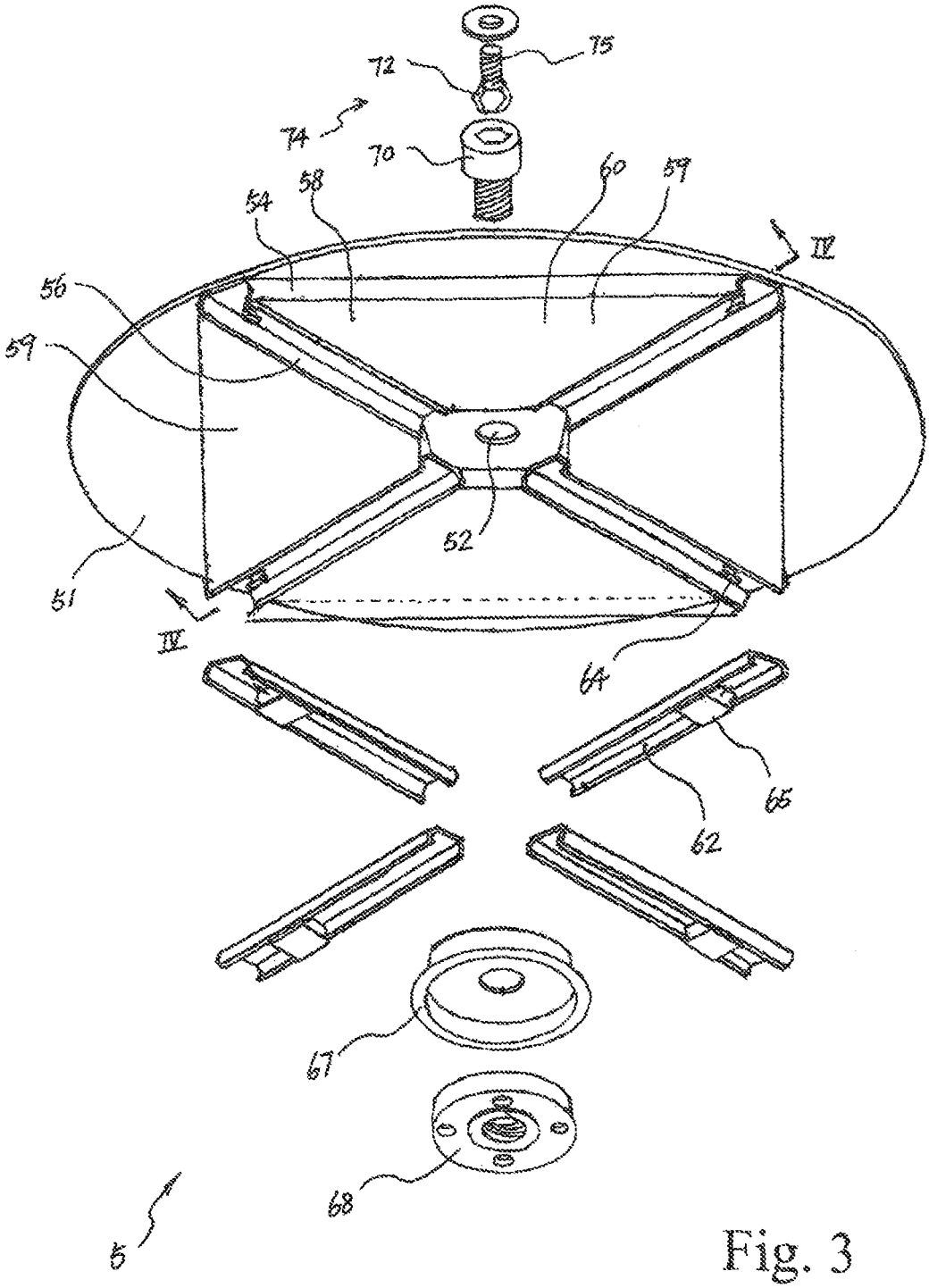
FIG. 3 is a schematic exploded view of a grinder part of the self-leveling sandpaper grinding machine shown in FIG. 1.
Figure 4:
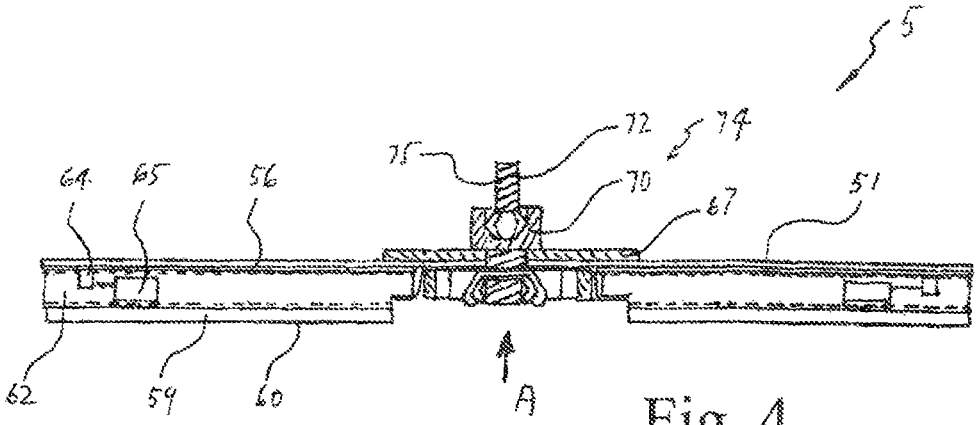
FIG. 4 is a cross-sectional view along a line IV-IV in FIG. 3, illustrating a sandpaper fastening device in the fastening status.
Figure 5:
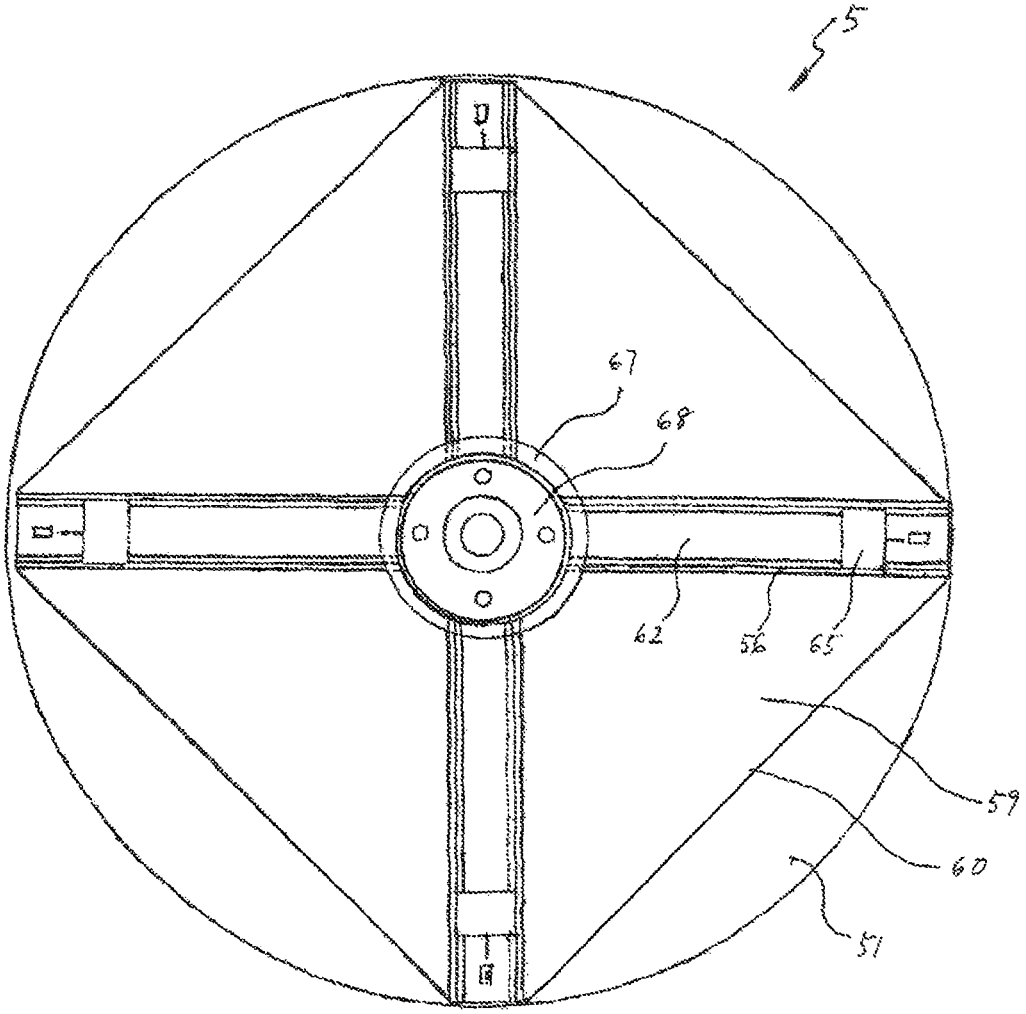
FIG. 5 is a view viewed from the direction A of FIG. 4.

As shown in FIGS. 3-5, the grinder part 5 includes a tray 51, and the tray 51 has a central hole 52. The tray 51 is provided with four barrier strips 54 substantively forming a quadrangle. Four U-shaped clip seats 56 are provided along the two diagonals of the quadrangle formed by the barrier strips 54. The barrier strips 54 and the clip seats 56 are fixed onto the tray 51, to form four sockets 58 in the shape of triangle. An elastic pad 59, such as a sponge pad, is inserted into each socket 58. The height of the elastic pads 59 is slightly higher than that of the barrier strips 54 and the clip seats 56, and the elastic pads 59 is covered by sandpaper 60. Four U-shaped clips 62 are provided for engaging with the clip seats 56 respectively, to enable to hold sandpaper 60 together with the latter. In this connection, the configuration of each U-shaped clip matches the inner configuration of the corresponding U-shaped clip seat. A clip buckle 64 is provided within each U-shaped clip seat 56 near the outer perimeter of the round tray 51, while a clip pin 65 could be provided for each U-shaped clip 62 in such manner that the clip pin 65 is movable along clip 62. When the sandpaper 60 is held, the clip buckle 64 and the corresponding clip pin 65 are engaged with each other, to fasten the clip 62 onto the corresponding clip seat 56. It should be understood that other suitable fastening devices could be applied for the clips 62 and clip seats 56, and the subject invention should not be limited thereto.

A clip pressing disk 67 could be provided at the center of the tray 51 to press on the clips 62 and clip seats 56 near the center, so as to fasten the clips 62, sandpaper 60 and elastic pad 59 together with the tray 51 by virtue of engagement of an inner-hexagon bolt 70 penetrating the central hole 52 and a clip nut 68. To enable to take out the clip pressing disk 67 from the clip nut 68 conveniently, four symmetrical small holes (as shown in FIG. 5) could be formed in the upper end of the clip nut 68 and are used for anchoring fitting tools. The inner-hexagon bolt 70 could couple to a main shaft 72 including six inclined planes at an angle of 10°-15°, which may constitute a transmission mechanism 74 for the tray 51 to enable the tray to incline in six directions. As illustrated in FIG. 4 the main shaft 72 forms a hex socket for engagement with the inner-hexagon bolt 70. The surface of the distal end of the main shaft 72 could be provided with screw 75 for engaging with the screw hole of the center shaft 34 or a key (not shown in the figures) for engaging with the key slot in the hole formed into the lower end of the center shaft 34, which enables the main shaft 72 to couple with the center shaft 34.

The coupling structure between the clip 62 and clip seat 56 shown in FIGS. 3-5 has other variants for fastening sandpaper. For example, each U-shaped chip seat 56 could be provided with a transverse pin (not shown in the figures) near the center of the tray 51, while the corresponding U-shaped clip 62 could be pivoted with respect to the transverse pin, to enable the U-shaped clip rotates between a close position for fastening the sandpaper 60 and an opening position. In this connection, the clip pressing disk 67 for pressing on the clips 62 and clip seats 56 could be omitted. Similarly, the above pin structure could be provided at the U-shaped clip seats and U-shaped clip near the periphery of the tray 51, to substitute the structure of clip buckle and clip pin.

The operation of the present self-leveling sandpaper grinding machine 1 is described in details with reference to FIG. 1. Firstly, the sandpaper 60 is placed on the elastic pad 59, and is fastened by virtue of the engagement of U-shaped clip 62 and U-shaped clip seat 56. In this connection, the sandpaper 60 is divided into four parts. Then, the grinder part 5 is mounted on the base part 3, and the transmission mechanism 74 of the grinder part 5 is coupled to the coupling device of the center shaft 34 of the base part 3. Finally, a user holds the handle 41 of the base part 3, and faces the sandpaper 60 of the grinder part 5 toward surface to be grinded and starts the motor to enable the grinder part 5 to rotate. Due to the structure of the transmission mechanism 74 with 6 inclined planes, the sandpaper of the grinder part could be attached to the object to be grinded tightly. In addition, the chips generated during grinding could be discharged from the periphery of the quadrangle formed by the barrier strips and by virtue of the U-shaped clip 62.

Although an embodiment of the self-leveling sandpaper grinding machine according to the present invention have been shown and described with reference to the accompanying drawings, those skilled in the art should understand that various changes and modifications can be made to the embodiments without departing the principles and spirits of the present invention and they still fall into the scope of claims and the equivalent thereof.

What is claimed is:

1. A self-leveling sandpaper grinding machine comprising:

a base part including a seat having a first side, a second side and a middle portion, a motor frame fixed in the middle portion on a first side of the seat, a motor supported on the motor frame, a decelerator connected to an output shaft of the motor wherein an output shaft of the decelerator penetrates the first side of the seat and extends to the second side of the seat; and a grinder part removably attached to the second side of the seat and being opposite to the motor being supported on the motor frame on the first side of the seat, said grinder part including a tray, four barrier strips provided on the tray and substantively forming a quadrangle, U-shaped clip seats provided along diagonals of the quadrangle, elastic pads inserted into sockets formed by the barrier strips and U-shaped clip seats wherein a height of each elastic pad is slightly higher relative to a height of each barrier strip or U-shaped clip seat, sandpaper placed on the elastic pads, U-shaped clips engaging with the U-shaped clip seats and fastening the sandpaper together with the U-shaped clip seats to the grinder part, and a transmission mechanism provided on the tray for coupling with the output shaft of the decelerator.

2. The self-leveling sandpaper grinding machine according to claim 1, wherein the decelerator includes a gear decelerator and a worm gear decelerator, in which the gear decelerator includes a small gear operatively connected to the output shaft of the motor and a large gear operatively engaging with the small gear, while the worm gear decelerator includes a worm connected to the large gear and a worm gear engaging with the worm, in which a center shaft of the worm gear constitutes the output shaft of the decelerator.

3. The self-leveling sandpaper grinding machine according to claim 2, wherein the transmission mechanism includes an inner-hexagon bolt fixed to the tray and a main shaft including six inclined planes at an angle of 10°-15° coupled with a hex socket of the inner-hexagon bolt.

4. The self-leveling sandpaper grinding machine according to claim 3, wherein a screw hole is formed into a lower end of the output shaft of the decelerator, while a screw is formed on surface of an end of the main shaft of the transmission mechanism to couple with the screw hole.

5. The self-leveling sandpaper grinding machine according to claim 3, wherein a hole is formed into a lower end of the output shaft of the decelerator with a key slot formed into a wall of the hole, while a key is formed on surface of an end of the main shaft of the transmission mechanism to couple with the key slot.

6. The self-leveling sandpaper grinding machine according to claim 1, wherein the base part is provided with a handle which is fixed to the motor a first side of the handle and is fixed to the seat by virtue of a handle tail on a second side of the handle.

7. The self-leveling sandpaper grinding machine according to claim 6, wherein the handle is provided with a start button of the motor.

8. The self-leveling sandpaper grinding machine according to claim 7, wherein the transmission mechanism includes an inner-hexagon bolt fixed to the tray and a main shaft including six inclined planes at an angle of 10°-15° coupled with a hex socket of the inner-hexagon bolt.

9. The self-leveling sandpaper grinding machine according to claim 8, wherein a screw hole is formed into a lower end of the output shaft of the decelerator, while a screw is formed on surface of an end of the main shaft of the transmission mechanism to couple with the screw hole.

10. The self-leveling sandpaper grinding machine according to claim 8, wherein a hole is formed into a lower end of the output shaft of the decelerator with a key slot formed into a wall of the hole, while a key is formed on surface of an end of the main shaft of the transmission mechanism to couple with the key slot.

11. The self-leveling sandpaper grinding machine according to claim 6, wherein the transmission mechanism includes an inner-hexagon bolt fixed to the tray and a main shaft including six inclined planes at an angle of 10°-15° coupled with a hex socket of the inner-hexagon bolt.

12. The self-leveling sandpaper grinding machine according to claim 11, wherein a screw hole is formed into a lower end of the output shaft of the decelerator, while a screw is formed on surface of an end of the main shaft of the transmission mechanism to couple with the screw hole.

13. The self-leveling sandpaper grinding machine according to claim 11, wherein a hole is formed into a lower end of the output shaft of the decelerator with a key slot formed into a wall of the hole, while a key is formed on surface of an end of the main shaft of the transmission mechanism to couple with the key slot.

14. The self-leveling sandpaper grinding machine according to claim 1, wherein the transmission mechanism includes an inner-hexagon bolt fixed to the tray and a main shaft including six inclined planes at an angle of 10°-15° coupled with a hex socket of the inner-hexagon bolt.

15. The self-leveling sandpaper grinding machine according to claim 14, wherein a screw hole is formed into a lower end of the output shaft of the decelerator, while a screw is formed on surface of an end of the main shaft of the transmission mechanism to couple with the screw hole.

16. The self-leveling sandpaper grinding machine according to claim 14, wherein a hole is formed into a lower end of the output shaft of the decelerator with a key slot formed into a wall of the hole, while a key is formed on surface of an end of the main shaft of the transmission mechanism to couple with the key slot.

17. The self-leveling sandpaper grinding machine according to claim 1, wherein each of the elastic pads is a sponge pad.

18. The self-leveling sandpaper grinding machine according to claim 1, wherein the operation of the grinder part is in a range of 200-500 rpm.

* * * * *